US006334462B1

(12) United States Patent
Dore et al.

(10) Patent No.: US 6,334,462 B1
(45) **Date of Patent: *Jan. 1, 2002**

(54) MECHANICALLY-CONTROLLED POWER TRANSMISSION DEVICE

(76) Inventors: Jacques Dore, 191, Rue Saint-Denis, 92700 Colombes; Francois Edwige, 53, Jardins Boieldieu, 92800 Puteaux, both of (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/978,880

(22) PCT Filed: Feb. 23, 1995

(86) PCT No.: PCT/FR95/00216

§ 371 Date: Jan. 22, 1996

§ 102(e) Date: Jan. 22, 1996

(87) PCT Pub. No.: WO95/23293

PCT Pub. Date: Aug. 31, 1995

Related U.S. Application Data

(63) Continuation of application No. 08/535,017, filed as application No. PCT/FR95/00216 on Feb. 23, 1995, now abandoned.

(30) Foreign Application Priority Data

Feb. 24, 1994 (FR) ..... 94 02127

(51) Int. Cl.[7] ..... F15B 13/044

(52) U.S. Cl. ..... 137/625.65; 251/129.11

(58) Field of Search ..... 137/625.65; 251/129.11

(56) References Cited

U.S. PATENT DOCUMENTS

| | | | | | |
|---|---|---|---|---|---|
| 3,818,926 | A | | 6/1974 | Wohlwend | |
| 4,133,511 | A | * | 1/1979 | Hartmann et al. | 137/625.65 X |
| 4,190,081 | A | * | 2/1980 | Coles | 137/625.65 X |
| 4,503,888 | A | * | 3/1985 | Brovold | 137/625.65 |
| 4,526,342 | A | * | 7/1985 | Wakefield | 137/625.65 X |
| 4,573,494 | A | * | 3/1986 | Spurbeck | 251/129.11 X |
| 4,645,178 | A | * | 2/1987 | Martin et al. | 137/625.65 X |
| 4,741,365 | A | * | 5/1988 | Van Ornum | 137/625.65 X |
| 4,864,210 | A | * | 9/1989 | Raber | 251/129.11 X |
| 5,036,886 | A | * | 8/1991 | Olsen et al. | 251/129.11 X |

FOREIGN PATENT DOCUMENTS

| | | | | |
|---|---|---|---|---|
| EP | 0 080 888 | | 8/1983 | |
| EP | 0 100 480 | | 2/1984 | |
| EP | 0 164 469 | | 12/1985 | |
| EP | 0 192 891 | | 9/1986 | |
| FR | 2 538 495 | | 6/1984 | |
| GB | 2133583 | * | 7/1984 | 137/625.64 |
| GB | 2 201 262 | | 8/1988 | |

* cited by examiner

*Primary Examiner*—Gerald A. Michalsky

(57) ABSTRACT

A direct drive valve includes a rotary motor transmitting a linear movement to a hydraulic valve through an arm linked to the engine and acting on a clevis integral with the valve. A spring acting on one end of the valve provides clearance adjustment of the connection between the engine and the valve and enables the return of the latter into a predetermined safety position in the event of breakdown of the system. The valve is for use in motor vehicle applications.

18 Claims, 8 Drawing Sheets

MECHANICALLY-CONTROLLED POWER TRANSMISSION DEVICE

This application is a continuation of application Ser. No. 08/535,017, filed Jan. 22, 1996, now abandoned, which was the National Stage of International Application No. PCT/FR95/00216, filed Feb. 23, 1995.

The invention concerns a mechanically-controlled power transmission device, in particular for automotive vehicle applications, such as control of braking pressure in a brake or the rapid correction of a hydropneumatic suspension.

Among the numerous present-day solutions to the problem of mechanically-controlled power transmission, hydraulic systems such as hydraulic servo valves appear the best suited for incorporation into vehicles or other motorized equipment, since they are inexpensive and can be easily and quickly adapted to new technical or economic requirements.

A hydraulic servo valve can be defined as the interface between an electric or electronic device supplying a control signal, and a hydraulic device designed to provide a response as a function of this electrical signal.

The characteristics required of a servo-valve are as follows:

- It must be usable for all automatic control applications, including:
  - automatic pressure control, for example in a brakecontrol mechanism,
  - automatic movement control, for example of the position of a hydraulic jack,
  - automatic flow control, for example in order to make rapid correction in the hydropneumatic suspension of a vehicle.
- The servo-valve must possess a high transmission band, so as to allow the rapid, stable response of the automatic control function, independently of the requisite hydraulic flow rate.
- The servo valve must be compatible with the conditions governing automotive operation, by providing:
  - a low cost price,
  - operation within a broad temperature range,
  - low level of sensitivity to impurities, thus requiring no major precautions for use and filtration of the hydraulic fluid,
  - low energy consumption,
  - a virtually nil hydraulic consumption under all circumstances,
  - lack of sensitivity to vibrations and acceleration.

A servo valve possessing all of these features is known, this valve comprising a rotary actuating element, such as a rotary electric motor of low inertia, controlled in position and connected by mechanical linkage means to a mechanical device such as a hydraulic distributor incorporating a linear valve, this motor being equipped with a return spring brasing it in its initial position.

A device of this kind is well suited for use in a vehicle, since the rotary electric motor is insensitive to vibrations and acceleration, which have no effect on its angular position. This is not the case in a linear motor, the metallic weight of which can be shifted because of the effect of inertia. Hydraulic distributors incorporating linear valves are currently in wide-spread use, in the automotive industry, since they are inexpensive, show little sensitivity to impurities, and since, because the very low weight of the valve, acceleration along its axis creates only very weak forces.

However, this conventionally-known device exhibits a number of problems related to the inevitable presence of clearances in the connection between the actuating element and the valve. The result is a degree of imprecision in the position of the valve and premature wear of the parts. Moreover, in the event of breakage of the mechanical linkages, the hydraulic valve may either remain in its position, which is not necessarily the position corresponding to the greatest driving safety in the event of breakdown of the hydraulic system, or it may shift uncontrollably.

Accordingly, the invention is intended to solve these problems by proposing a mechanically-controlled power-transmission device comprising an actuating element, or rotary motor, and linkage means connecting this actuating element to a mechanical device such as a hydraulic valve, in order to transmit linear motion to this valve, this device being characterized by the fact that it comprises means for clearance adjustment and for return of the mechanical device into a predetermined safety position.

Other features of the device according to the invention include:

- because the valve can establish or prevent connection between at least one user device and either one high-pressure source or exhaust, the predetermined safety position is a position in which linkage is created between said user device, on the one hand, and the high-pressure source or exhaust, on the other;
- the clearance-adjustment and mechanical device-return means act directly on the valve;
- the clearance-adjustment and mechanical device-return means comprise a spring or comparable mechanism which acts on the end of the valve;
- said device further comprises means for ensuring the return motion of the motor into a predetermined neutral position;
- said device also comprises additional return-motion means incorporated into the linkage mechanism;
- the axis of rotation of the motor is perpendicular to the axis of the valve;
- the linkage mechanism comprises a lever fastened to the rotor of the motor and of which one arm, located at a determinate distance from the axis of rotation of the latter, acts on a part fastened to the valve;
- the lever comprises a first arm extending perpendicularly to the axis of rotation of the motor and of which one end is attached to the rotor at said axis, and a second arm constituting the aforementioned arm and extending perpendicularly to the first;
- said part integral with the valve is in the shape of a clevis, and said arm has a barrel-shaped part acting on this clevis;
- said arm is linked to the valve by means of a connecting rod whose two ends are jointed to the arm and the valve, respectively, by means of ball joints;
- said device is configured in such a way that, in the central position of the valve, at least one of the following conditions is fulfilled:
  - the motor lies substantially in the middle of its course of travel,
  - the lever is perpendicular to the valve axis,
  - the axis of the valve is concurrent with the axis of the arm or of the ball joint of the lever;
- the axis of rotation of the motor is collinear to the axis of the valve;
- the linkage mechanism comprises at least one roller integral with the valve and whose axis is perpendicular to the valve, and which slides on a helical inclined surface provided in the wall of a cylindrical part driven by the motor in rotation a round its own axis , which is parallel, and preferably collinear, to the axis of the motor, and means for maintaining the axis of said roller in translational motion in a direction parallel to the axis of the valve;

said translational motion-maintenance means comprise at least one guide roller having the same axis as the first and also integral with the valve, this guide roller being able to roll in a groove parallel to the axis of the valve and cut in a stationary part;

the linkage mechanism comprises:

a first plate arranged perpendicularly to the axis of the motor and driven in rotation by the latter;

a second plate attached to the valve casing and positioned opposite and parallel to the first; and at least one lever incorporating:

a first arm whose ends are jointed to each of the two plates; and a second arm forming a non-null angle with the first and acting on the end of the valve;

said device comprises a return spring in the area of the plates;

the valve comprises a rod fitted with blocks which slide in a bore in a sleeve and which are capable of freeing or sealing radial holes connecting with said user device, the high-pressure source and the exhaust, at least one of the holes having a non-circular section and being configured so that his section increases gradually and uniformly as it is freed by the corresponding block when the valve moves;

said hole has a circular or similar section on one side and ends in a point on the opposite side;

the hole(s) end(s) in an annular groove provided on the outside of the valve sleeve and/or in an annular groove provided on the wall of the bore;

the bore has two orifices, each connecting with a user device, two orifices connecting with the exhaust, and one orifice connecting with the high-pressure source, the number and arrangement of the blocks being such that, when one user device is connected to the exhaust, the other is connected to the high-pressure source, and vice-versa.

The invention will be better understood from a reading of the following description provided solely as an example and with reference to the attached drawings, in which.

Figure 5:
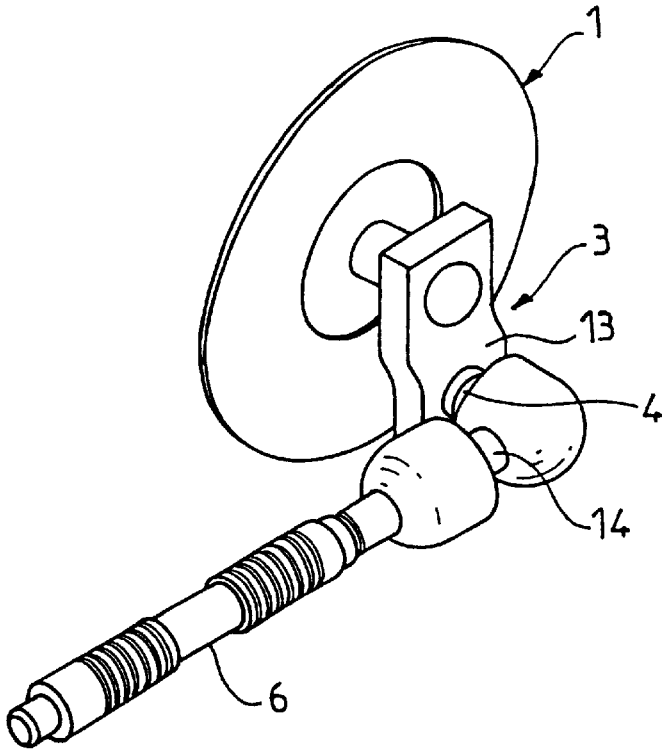
Figure 6:
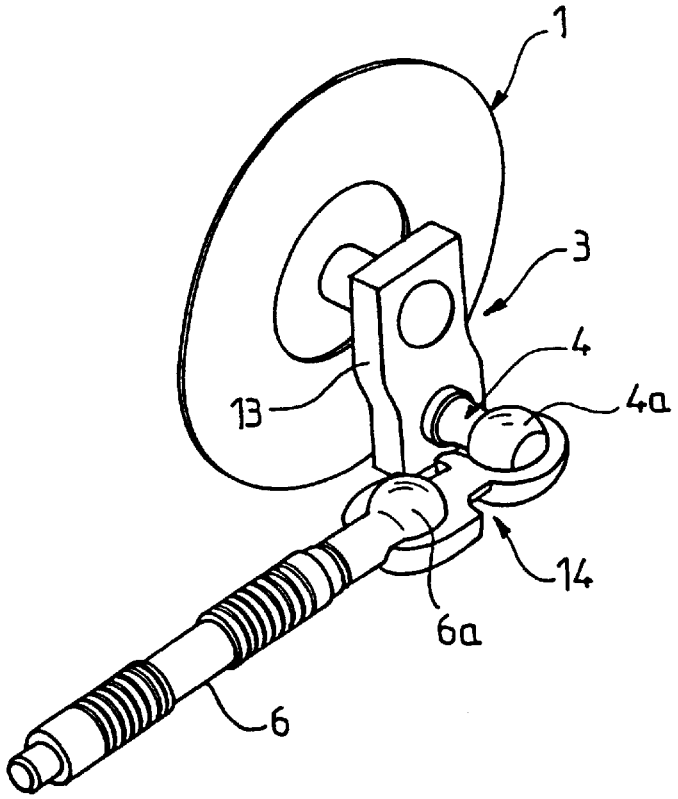
Figure 7:
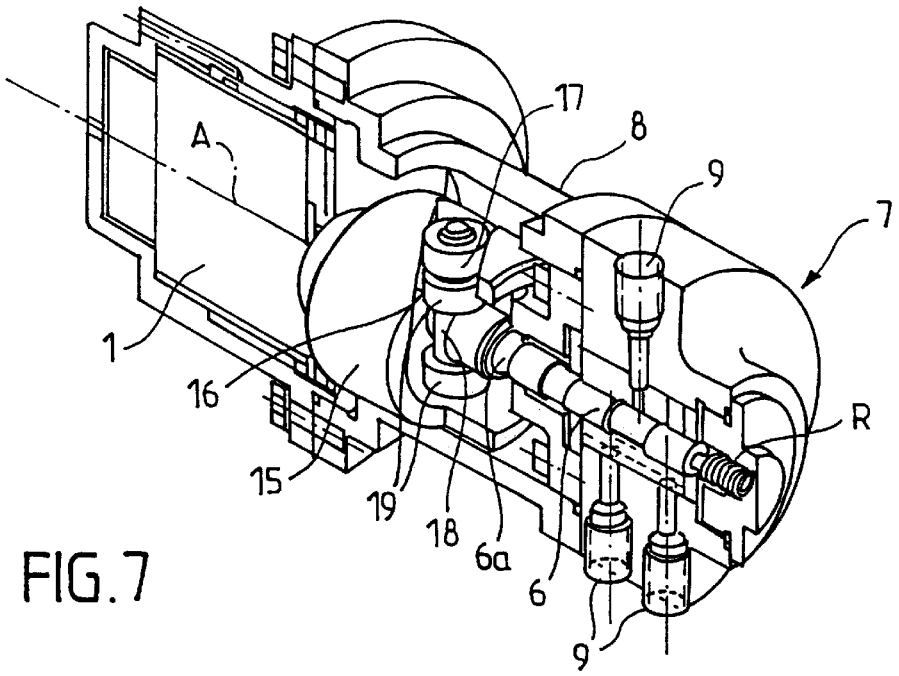
Figure 8:
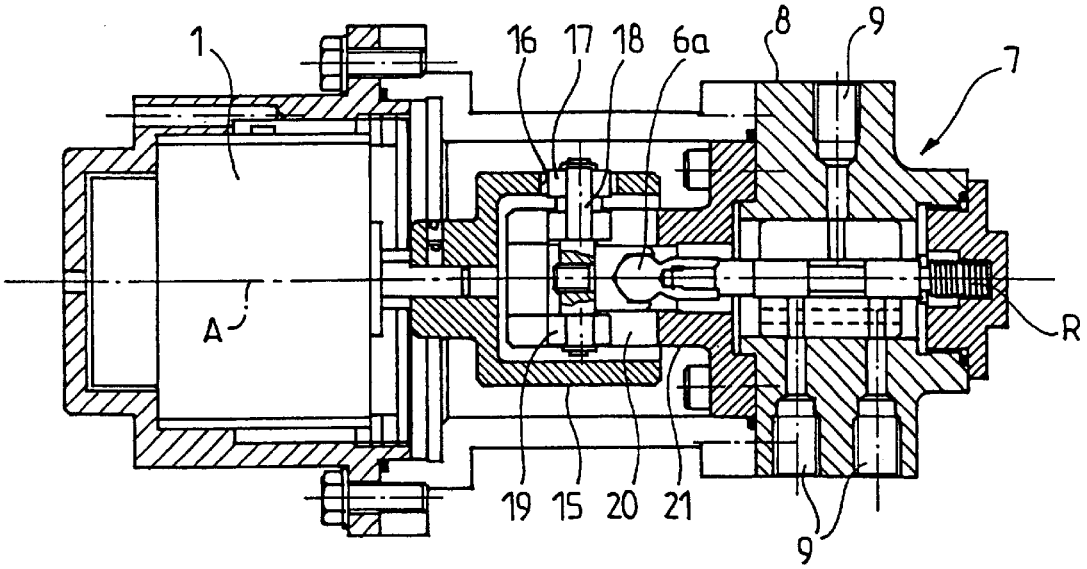
Figure 9:
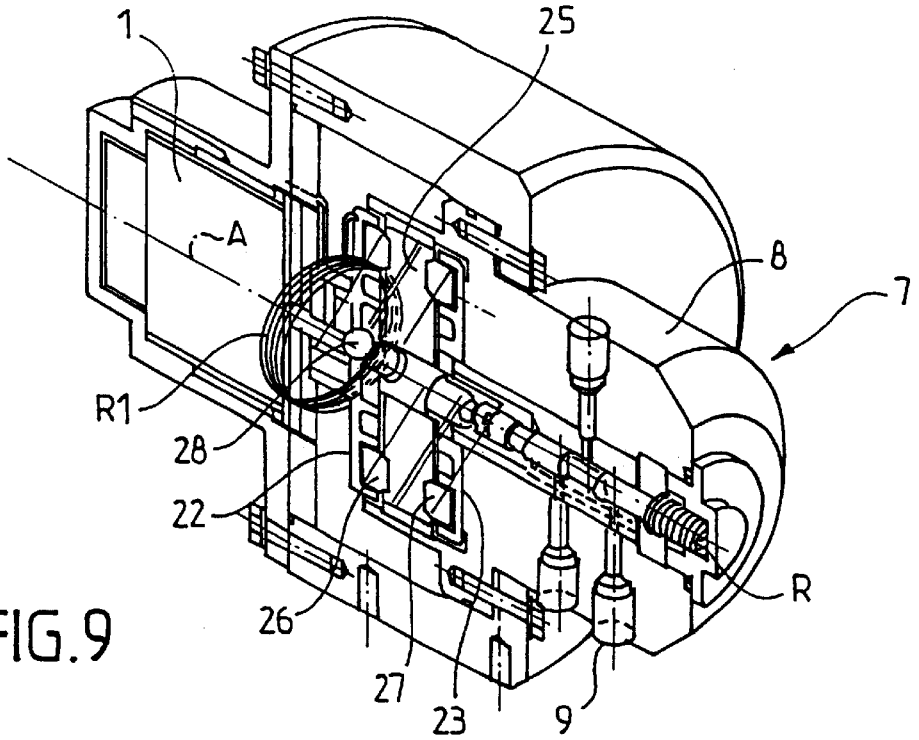
Figure 10:
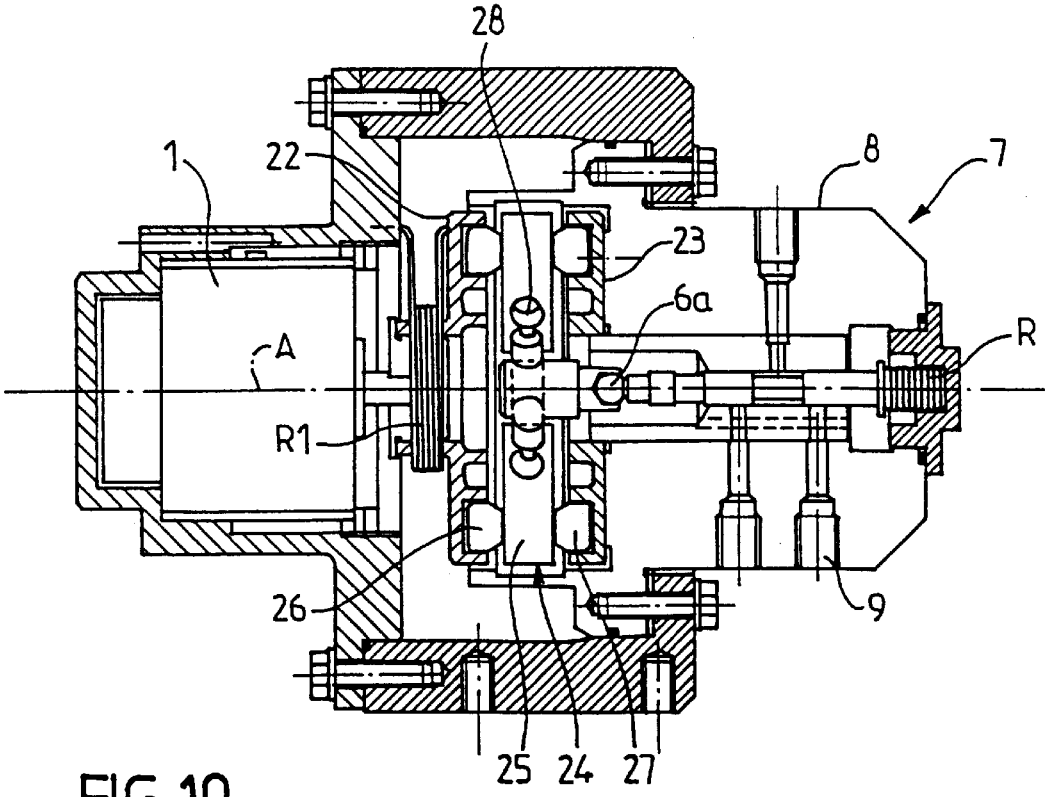
Figure 11A:
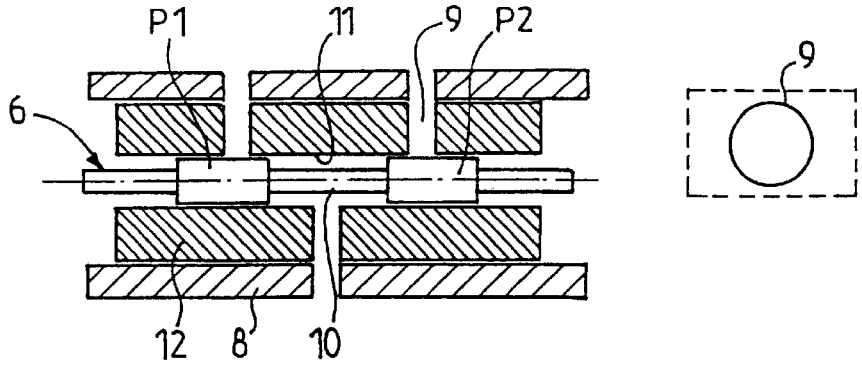
Figure 11B:
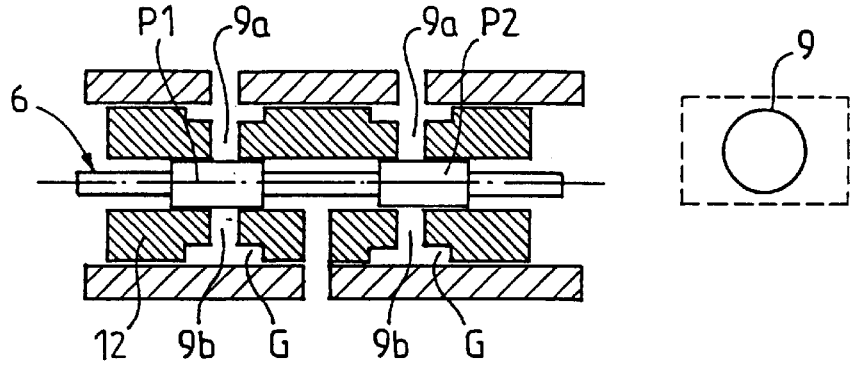
Figure 11C:
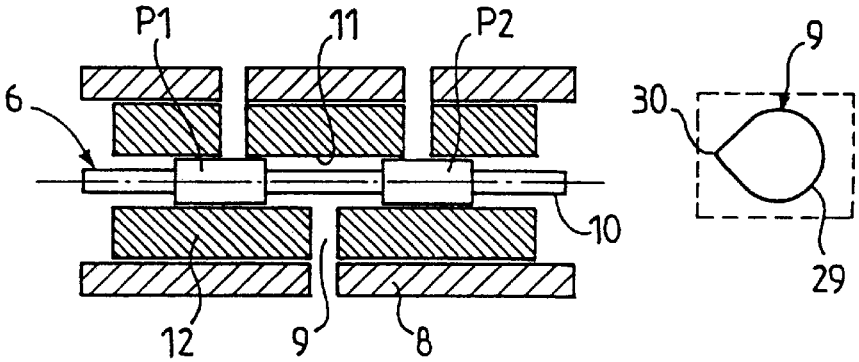
Figure 11D:
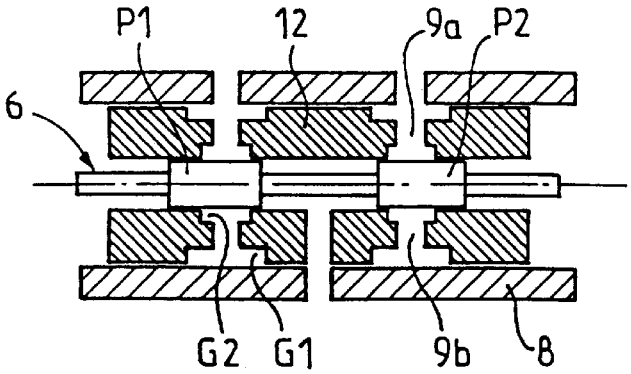
Figure 12:
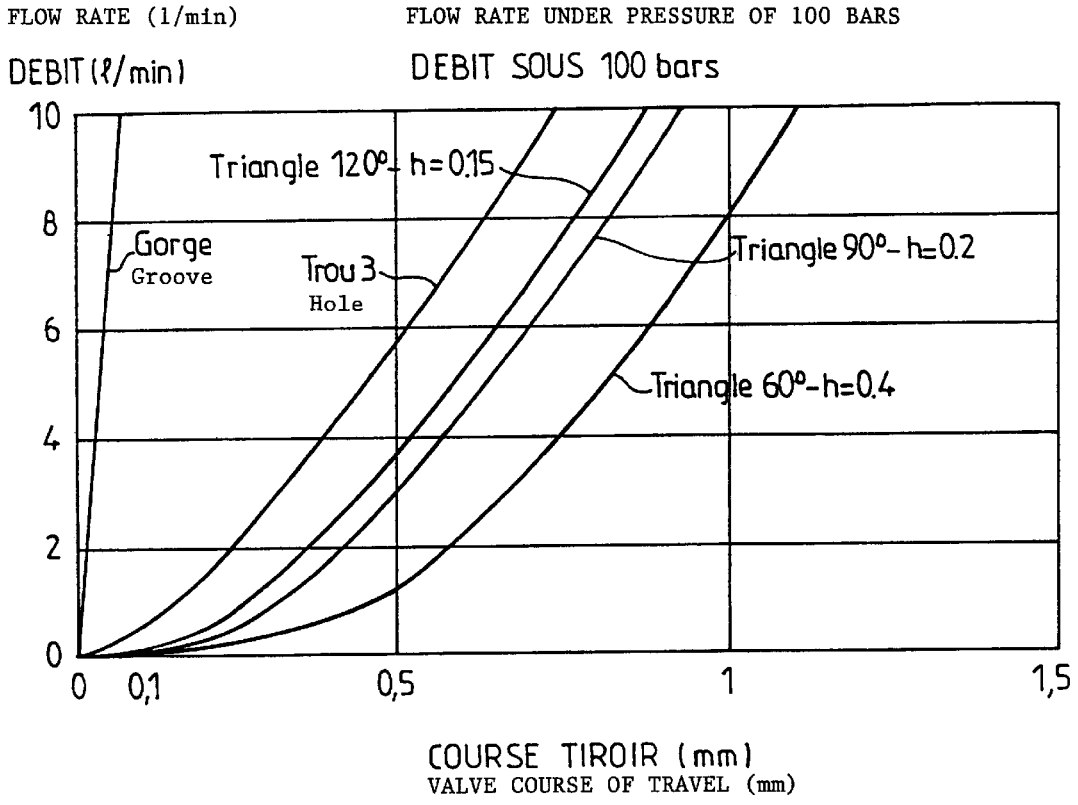

FIGS. 4*a*–4*d* are enlarged schematic cross-sections illustrating several possible embodiments of the hydraulic valve;

FIG. 5 is a schematic perspective view of the linkage between the motor and the valve formed using ball joints;

FIG. 6 is a view similar to that in FIG. 5 and partially torn away to show the ball joints;

FIG. 7 is a schematic cross-section in perspective showing an embodiment in which the axis of the motor is collinear to that of the valve;

FIG. 8 is a raised cross-section view of the device in FIG. 7;

FIG. 9 is a schematic cross-section view in perspective of another embodiment, in which, once again, the axis of the motor is collinear to the axis of the valve;

FIG. 10 is a raised cross-section of the device in FIG. 9;

FIG. 11*a* to 11*d* are enlarged schematic cross-sections of various forms of the distributor having or not having annular grooves and incorporating different hole sections; and FIG. 12 is a graph showing the flow rate as a function of the course of travel of the valve in various embodiments illustrated in FIG. 11*a* to 11*d*.

Figure 1:
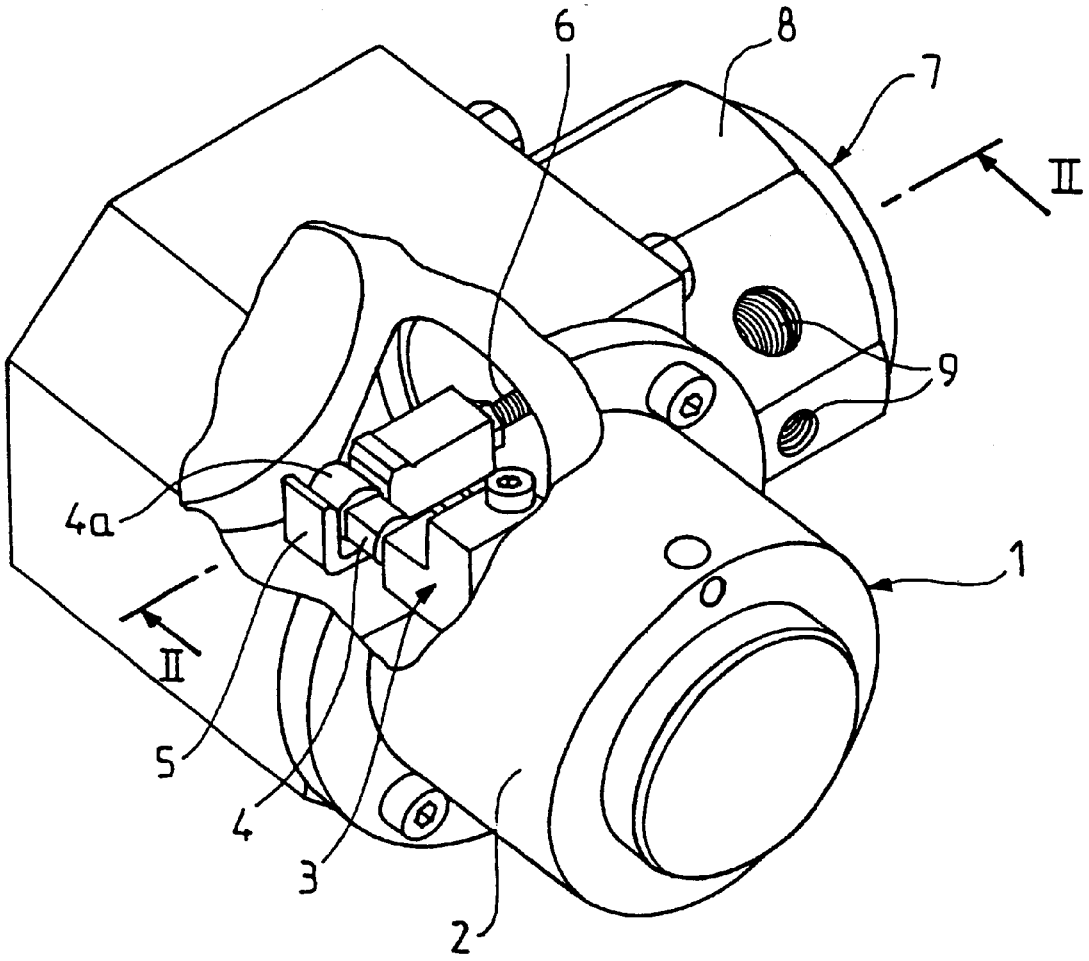
FIG. 1 is a schematic perspective view of a device according to the invention, the axis of the motor being perpendicular to that of the valve.

FIG. 1 illustrates a first embodiment of the device according to the invention and comprising a rotary electric motor 1 mounted in a housing 2, of which a portion is torn away on the drawing. The rotation of the motor drives a lever 3, to be described in greater detail below, which ends in an arm 4 whose end 4*a* is housed in a clevis-shaped part 5 provided at one end of the valve 6 of the distributor 7. Reference number 8 designates the distributor casing, in which holes 9 are drilled to allow connection with the various components of the hydraulic circuit, such as the high-pressure source, the exhaust, and various user devices.

In this embodiment, the axis of the arm 4 is parallel to the axis of rotation of the motor, these two axes being perpendicular to that of the valve.

Figure 2:
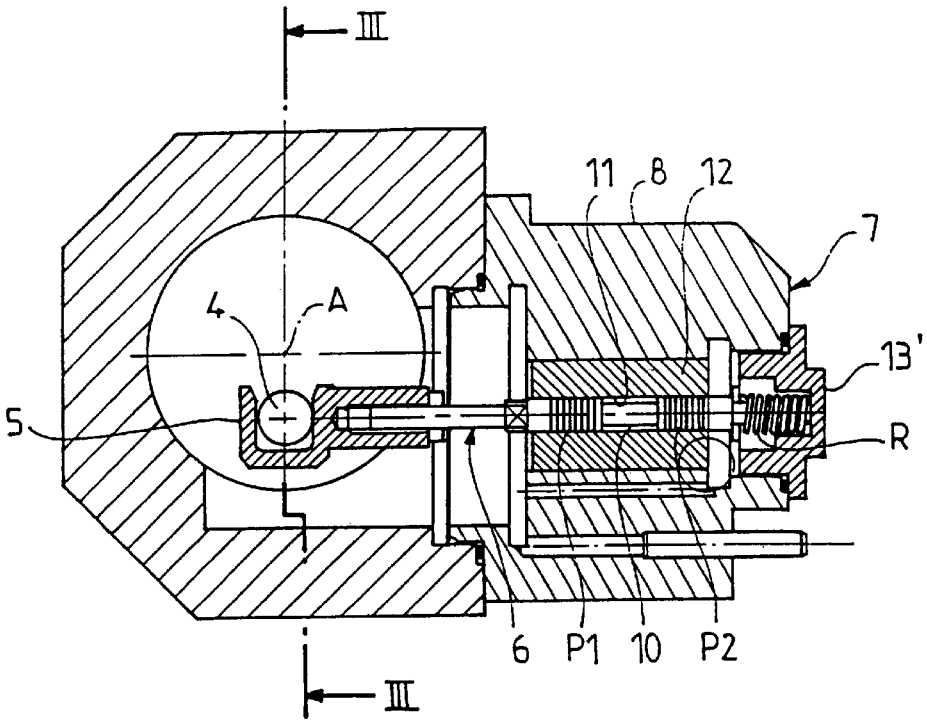
FIG. 2 is a cross-section along line II—II in FIG. 1.

FIG. 2 is a cross-section showing with greater precision the form of the clevis 5 and of the valve 6, which basically comprises a shaft 10 fitted with two blocks P1 and P2, which slide in the bore 11 of a sleeve 12, which is, in turn, positioned in the casing 8. A return spring R interposed between a part such as a plug 13' integral with the casing and the end of the valve opposite the clevis 5, ensures, in accordance with the main feature of the device according to the invention, clearance adjustment and the return motion of the valve into a predetermined position in the event of breakage of the linkage.

As will be seen in greater detail below, the arm 4 is connected to the rotor of the motor by the lever 3, so that one low-amplitude oscillation of the rotor around the axis A produces a movement of the arm 4 describing an arc centered on A and tangent to the axis of the valve. The effect of this motion is to produce linear motion of the valve along its axis, since it is guided in translational motion by the bore 11.

Figure 3:
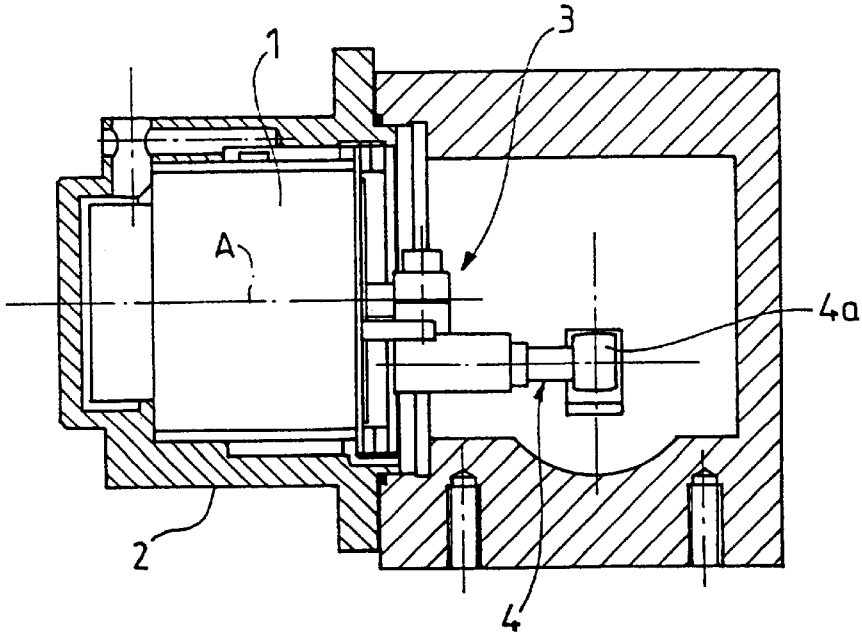
FIG. 3 is a cross-section along line III—III in FIG. 2.

Preferably, the end 4*a* of the arm 4 in contact with the clevis is barrel-shaped, the axis of the barrel coinciding with the axis of the arm 4, as shown in FIG. 3. This configuration provides a small degree of free motion, in order to compensate for any possible defects of alignment and while minimizing the contact pressures between the two parts.

FIGS. 4*a* to 4*d* illustrate various possible embodiments of the valve 6.

Figure 4A:
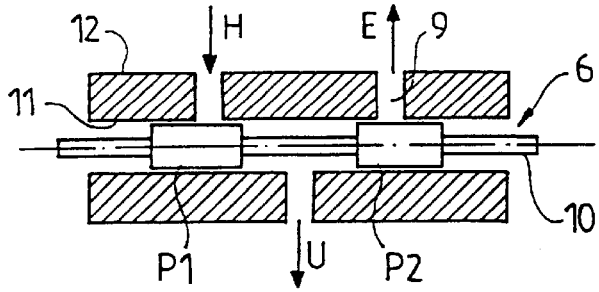

The embodiment in FIG. 4*a*, which is the simplest, corresponds to FIG. 2 and incorporates the shaft 10 fitted with the blocks P1 and P2 which slide in the bore 11 of the sleeve 12. The sleeve is drilled with three holes 9 allowing connection with a high-pressure source, an exhaust, and a user device. These three passages are symbolized by the letters H, E, and U, respectively, and the latter opens into the bore 11 at the mid-point between H and E. The holes drilled in the sleeve are in alignment with those drilled in the casing and, for that reason, have the same reference numbers.

Figure 4B:
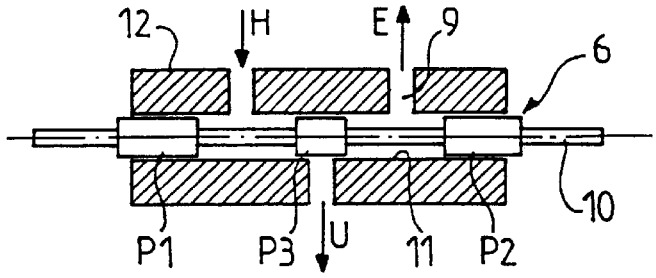
Figure 4C:
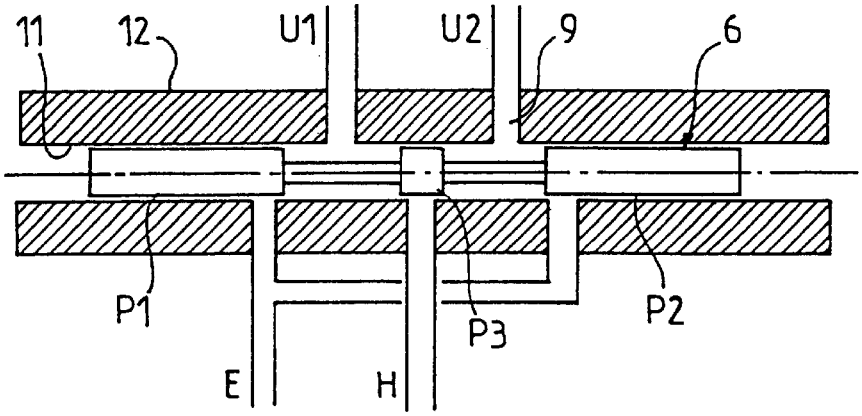
Figure 4D:
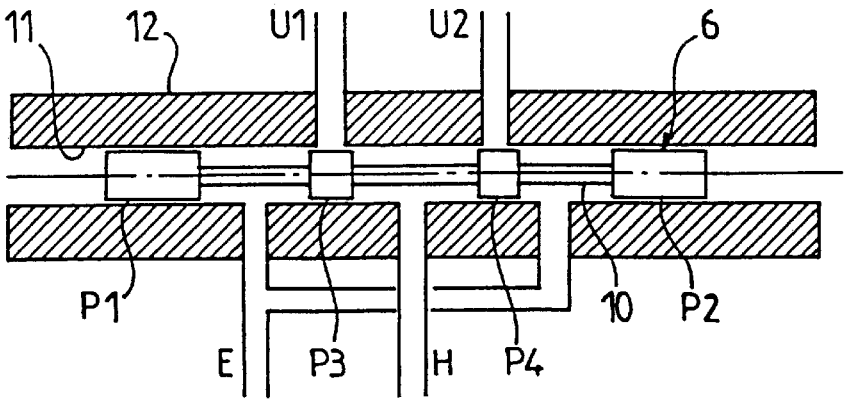

In the position illustrated, which is the neutral position as in FIG. 4*b* to 4*d*, the blocks P1 and P2 seal H and E, respectively, and no connection is established. It can be easily seen that a movement of the valve connects the user device U either with H or with E. In the event of breakdown of the linkage with the motor, the return spring R, which is positioned to the right in FIG. 4*a*, pushes the valves into the position in which U connects with H; however, it would suffice to modify the hydraulic circuit to establish a connection with E.

In FIG. 4*b*, there is an additional block P3 positioned mid-way between P1 and P2. In the neutral position, P3 seals U, while P1 and P2 are positioned beyond H and E.

FIGS. 4*c* and 4*d* illustrate an embodiment in which there are two user devices U1 and U2. The high-pressure source H opens mid-way between U1 and U2, while the exhaust E connects with the bore 11 through two holes located beyond U1 and U2.

In FIG. 4*c*, there are three blocks, P1 and P2 being longer than in the embodiment shown in FIG. 4*b*. In the neutral position, P3 seals H, while P1 and P2 seal the exhaust holes.

Finally, in FIG. 4*d* there are four blocks P1 to P4, arranged in such a way that, in the neutral position, P3 and P4 seal U1 and U2, respectively, while P1 and P2 (which are shorter than in FIG. 4*c*) are positioned beyond the exhaust holes.

FIGS. 4*c* and 4*d* show that, if U1 is connected to the exhaust, U2 connects with the high-pressure source, and vice-versa.

It should be noted that, in the neutral position, the blocks sealing one hole extend beyond this hole in such a way that minimal motion, called "overlap," is necessary before connection can be established. This overlap eliminates internal leakage of the hydraulic fluid and, therefore, interference consumption of this fluid. Accordingly, pressure generation can be calibrated to the lowest possible level. Furthermore, the provision of overlap yields another advantage, since there is no longer any reason to provide for very small tolerances, thereby reducing the manufacturing cost. In fact, the overlap may vary considerably without impairing the operation of the device.

Another embodiment of the linkage between the motor and the valve will now be described with reference to FIGS. 5 and 6, while still conforming to the configuration in which the axis of the motor is perpendicular to the axis of the valve.

The perspective view in FIG. 5, which is purposely shown highly simplified, illustrates only the front face of the motor 1, the valve 6, and the linkage joining them. This drawing shows the lever 3, which consists of a first arm 13 extending perpendicularly to the axis of the motor and of which one end is attached to the motor, and a second arm 4 attached to the other end of the first arm and extending perpendicularly to this first arm 13.

A connection rod 14 provides the connection between the lever 3 and the valve 6 by means of ball joints, which are visible on the partially torn-away view in FIG. 6. In this embodiment, the end 4*a* of the arm and the end 6*a* of the valve exist as ball joints lodged in corresponding housings in the aforementioned connection rod 14.

Preferably, in the embodiments just described, in order to provide the best possible geometry of the assembly and to provided for the requisite courses of travel of the valve, the assembly is produced in such a in the central position of the valve, that is, in which there is equal overlap for both intake and exhaust:

- the motor is positioned substantially at the mid-point of its course of travel;
- the lever 3 is perpendicular to the axis of the valve;
- the axis of the valve is concurrent with the axis of the arm 4 or of the ball joint 4*a* of the lever.

The phrase "the lever 3 is perpendicular to the axis of the valve" means that it is the arm 13 of this lever (or the plane containing the two arms 13 and 4) which is perpendicular to the axis of the valve. The axis of the ball joint refers to the axis of its tail end which, in FIG. 6, is formed by the arm 4 itself.

In all cases, the relationship between the angle of rotation of the motor and the course of travel of the valve is determined by the configuration and dimensions of the lever.

FIGS. 7 and 8 and 9 and 10 illustrate, respectively, two configurations in which the axis of the motor is collinear to the axis of the valve.

In FIGS. 7 and 8, the linkage is formed basically by a cylindrical part 15 whose axis coincides with the axis of the motor and is actuated directly by this motor. The part 15 incorporates a helical groove 16 allowing the movement of a roller 16 mounted at one end of a shaft 18 positioned at one end of the valve 6 and extending perpendicularly to this valve, the axis of rotation of the roller coinciding with that of the shaft 18.

Two guide rollers 19 are mounted on the shaft 18 on either side of the valve 6 with the same orientation as the roller 17, and slide in grooves 20 parallel to the axis of the valve, which are provided in a part 21 integral with the valve casing. Accordingly, rollers 17 and 19 and the shaft 18 can move only in translational motion along the axis of the valve.

It will be noted here that the cylindrical part 15 is sealed at the end close to the motor and open at its other end, in order to house the corresponding end of the valve and the part 21.

The device illustrated in FIGS. 7 and 8 works in the following manner:

The rotation of the motor 1 drives the cylindrical piece 15 in rotation, and the groove 16 causes travel of the roller 17, thereby moving the valve linearly, since the rollers can move only in translational motion along the valve axis.

FIGS. 7 and 8 clearly show the holes 9 which establish connection between the distributor 7 and the rest of the hydraulic circuit, as well as the spring R, which provides clearance adjustment and the return motion of the valve in the event the connections are broken. It will be noted, finally, that the valve 6 is preferably connected to the shaft 18 by means of a ball joint 6*a*, in order to compensate for any possible defects of alignment.

In the embodiment shown in FIGS. 9 and 10, the motor is configured as previously described, but the linkage is formed by two circular plates 22 and 23 arranged opposite each other, and whose axis coincides with the axis A shared by the motor and the valve. The first plate 22 is driven in rotation by the motor, while the second plate 23 is attached to the housing 24 of the distributor 7. Levers 24 are mounted between the plates, these levers consisting of an arm 25 extending between the plates and of which one end is jointed to each of the plates 22, 23 by means of ball joints 26, 27, respectively, and whose other end is jointed to a ball joint 28 integral with the valve. The common axis of the ball joints 26, 27 is perpendicular to the arm 25, and, in conjunction with the latter, the ball joints form two arms perpendicular to each other.

In the neutral position, the arm 25 extends parallel to the plates, and the axis of the ball joints 26 and 27 is parallel to the axis of the valve. The rotation of the motor drives the plate 22 in rotation. Because the plate 23 is stationary, the axis of the ball joints 26 and 27 is no longer parallel to the valve, and the arm 25 changes its orientation, thereby causing the movement of the valve 6 by means of the ball joint 28.

The distributor configuration is the same as in FIGS. 7 and 8 and incorporates the holes 9, the return spring R and the ball joint 6a by means of which the valve 6 is jointed to the part supporting the ball joints 28. If necessary, an additional return spring R1 interposed between the motor 1 and the plate 22 may be provided.

FIGS. 11*a* to 11*d* illustrate several possible embodiments of the distributor used in the device according to the invention. In all cases, there are only two blocks P1 and P2 and three connections with a high-pressure source, an exhaust, and a single user device.

FIG. 11*a* illustrates the simplest case (similar to that in FIG. 4*a*), in which each hole in the sleeve 12 and the casing 8 has a circular section and the same diameter, and all are continuous with each other.

In the case shown in FIG. 11*b*, two holes 9*a* and 9*b*, which are reciprocally aligned and connected by an annular groove G, are provided in the sleeve in the area of the intake (connection with the high-pressure source) and of the exhaust.

In the embodiment shown in FIG. 11*c*, there are only three holes 9 drilled in the sleeve 12, but the holes connecting with the intake and the exhaust do not have a circular section. This section consists of a first circular portion 29 on one side and a second portion 30 ending in a point on the opposite side. The portion 30 thus forms an isosceles triangle connecting more or less tangentially to the circular portion 29. This configuration gives a more gradual flow rate, as the corresponding block uncovers the portion 30, than in the case of a circular section.

Finally, in the embodiment in FIG. 11*d*, as in FIG. 11*b*, two aligned holes 9*a* and 9*b* having a circular section are drilled in the sleeve 12 in the area of the intake and the exhaust. However, two annular grooves are provided in the sleeve 12, one on the outside G1 and one on the inside G2 in the area of the bore 11.

FIG. 12 gives, for various configurations of the distributor, the curves of the flow rate laws (in liters per minute) as a function of the course of travel of the valve (in millimeters), as the corresponding block frees the hole in question, for a feed under a pressure of 100 bars.

The curves C1 to C3 correspond to FIG. 11*c* for different angles at the tip or potion 30, h being the height of the aforementioned isosceles triangle. The curve C4 corresponds to a circular hole having a diameter of 3 mm as shown in FIG. 11*a*, and curve C5, to the existence of an inner groove as illustrated in FIG. 11*d*.

The device according to the invention thus has special advantages, since, on the one hand, the rotary motor is insensitive to acceleration and interference vibrations, and, on the other, the absence of clearances in the mechanical linkages resulting from the return-motion mechanism allows greater precision of the positioning of the valve and prevents premature wear of the parts. In addition, in the event of breakage of the mechanical linkages, the valve adopts a completely determinate position.

Finally, while the preceding description corresponds to an automotive application, the device according to the invention can be used in any type of equipment, either mobile or stationary.

What is claimed is:

1. Mechanically-controlled power-transmission device comprising an actuating device including a rotary motor having a rotor and an axis of rotation, linking means connecting this actuating device to an hydraulic valve in order to transmit a linear motion to the latter, the hydraulic valve having an axis, and means for clearance adjustment and return of the hydraulic valve to a predetermined safety position, wherein said device further incorporates means for returning the rotary motor to a predetermined neutral position; and wherein the axis of rotation of the rotary motor is perpendicular to the axis of the hydraulic valve; wherein the linkage means includes a lever integral with the rotor of the motor and having one arm located at a predetermined distance from the axis of rotation of said motor acting on a part fastened to the hydraulic valve; and wherein the lever includes a first arm extending generally perpendicular to the axis of rotation of the motor, with one end attached to the rotor in proximity to the axis, and a second arm being the aforementioned one arm and extending generally perpendicularly to the first arm.

2. Device according to claim 1, wherein, the valve can regulate connection between at least one user device and one of a high-pressure source and an exhaust, the predetermined safety position is a position in which a connection is established between said user device, on the one hand, and one of the high-pressure source and the exhaust, on the other.

3. Device according to claim 1 wherein the means for clearance adjustment and return of the hydraulic valve act directly on the valve.

4. Device according to claim 3, wherein the means for clearance adjustment and return of the hydraulic valve comprise a spring mechanism acting on one end of the valve.

5. Device according to claim 1, wherein said device comprises additional return means incorporated into the linkage means.

6. Device according to claim 1, wherein said part fastened to the valve is in the form of a clevis, and said first arm has a barrel-shaped part which acts on this clevis.

7. Device according to claim 1, wherein said first arm is connected to the valve by means of a connecting rod whose two ends are jointed to the first arm and valve, respectively, by means of ball joints.

8. Device according to claim 1, wherein said device is configured in such a way that the valve has a central position, and, in the central position of the valve, at least one of the following conditions is fulfilled:

the motor lies substantially in the middle of its course of travel, the lever is perpendicular to the valve axis, the axis of the valve is concurrent with one of the axis of the first an and arm axis of a ball joint of the lever.

9. Device according to claim 1, wherein the axis of rotation of the motor is collinear to the axis of the valve.

10. Device according to claim 9, wherein the linkage means comprise at least one roller fastened to the valve and having an axis perpendicular to said valve, said roller sliding on a helical inclined surface provided in the wall of a cylindrical part driven by the motor in rotation around its own axis, which is parallel to the axis of the motor, and means for maintaining the axis of said roller in translational motion in a direction parallel to the axis of the valve.

11. Device according to claim 10, wherein said means for maintenance of translational motion comprise at least one guide roller having the same axis as the first and also fastened to the valve, this guide roller being able to roll in a groove parallel to the axis of the valve provided in a stationary part.

12. Device according to claim 9, wherein said linkage mechanism comprises:

a first plate positioned perpendicularly to the axis of the motor and driven in rotation by the latter;

a second plate fastened to the casing of the valve and placed opposite and parallel to the first; and at least one lever comprising:

a first arm whose ends are jointed to each of the two plates; and a second arm forming a non-null angle with the first and acting on one end of the valve.

13. Device according to claim 12, wherein said device comprises a return spring in proximity to the plates.

14. Device according to claim 1, wherein the valve comprises a rod fitted with blocks which slide in a bore in a sleeve and a can both clear and seal radial holes connecting with a user device, a high-pressure source, and an exhaust and wherein the holes have a circular section.

15. Device according to claim 14, wherein the hole opens into at least one of an annular groove provided on the outside of the sleeve of the valve and an annular groove provided on the wall of the bore.

16. Device according to claim 14, wherein the bore has two holes connecting with the exhaust and one hole connecting with the high-pressure source, the number and arrangement of the blocks being such that, when one user device is connected to the exhaust, a second user device is connected to the high-pressure source, and vice-versa.

17. Device according to claim 1, wherein, the valve comprising a rod fitted with blocks and which slide in a bore in a sleeve and can both clear and seal radial holes connecting with a user device, a high-pressure source, and an exhaust, at least one of the holes has a non-circular section configured in such a way that this section increases gradually and uniformly as it is freed by the corresponding block during travel of the valve.

18. Device according to claim 17, wherein said hole has a generally circular section on one side, and ends in a point on the opposite side.

* * * * *